United States Patent [19]

Ware et al.

[11] Patent Number: 4,492,169

[45] Date of Patent: Jan. 8, 1985

[54] ADJUSTABLE CANTILEVERED SHELVING

[75] Inventors: Warren O. Ware; Gary M. Borst; Ronald E. Abitz, all of Oshkosh, Wis.

[73] Assignee: S.B.F. Corporation, Oshkosh, Wis.

[21] Appl. No.: 365,592

[22] Filed: Apr. 5, 1982

[51] Int. Cl.[3] ..... A47B 9/00

[52] U.S. Cl. ..... 108/6; 248/222.4; 211/150; 108/108

[58] Field of Search ..... 211/150, 193; 248/242, 248/222.4; 108/6, 108

[56] References Cited

U.S. PATENT DOCUMENTS

| | | | |
|---|---|---|---|
| 1,371,256 | 3/1921 | Michaelson . | |
| 1,554,137 | 9/1925 | Slifkin | 108/6 |
| 2,767,950 | 10/1952 | Bellon et al. . | |
| 2,906,486 | 9/1959 | Bellon et al. . | |
| 3,485,382 | 12/1969 | Larson . | |
| 3,538,860 | 11/1970 | Fisher . | |
| 3,612,288 | 10/1971 | Lesley | 211/150 X |
| 4,067,532 | 1/1978 | Viteretto | 248/222.4 X |
| 4,250,815 | 2/1981 | Swanson . | |

FOREIGN PATENT DOCUMENTS

| | | | |
|---|---|---|---|
| 255059 | 6/1967 | Austria | 248/242 |

*Primary Examiner*—William E. Lyddane
*Assistant Examiner*—Peter A. Aschenbrenner
*Attorney, Agent, or Firm*—Willian, Brinks, Olds, Hofer, Gilson & Lione, Ltd.

[57] ABSTRACT

An adjustable cantilevered shelf is disclosed comprising upright supports and a shelf with a pivotally engaged bracket for supporting the shelf on the supports from either above or below. The shelf and bracket are attachable to keyhole slots in the upright supports. The relative positions of the shelf and the bracket in the keyhole slots adjusts the angle of inclination of the shelf.

5 Claims, 6 Drawing Figures

10
12
14
20
22
24
26
28
30
32
34
36
37
38
40
50
60
2.
3.
4.

ADJUSTABLE CANTILEVERED SHELVING

BACKGROUND OF THE INVENTION

This invention relates to adjustable cantilevered shelving. It was developed to primarily fill a need in the field of commercial refrigerator and freezer enclosures. Utilization of horizontal and vertical lighting systems and other enclosure characteristics often require that the shelves be supported entirely by a rear suspension.

In most refrigeration shelving, shelf removal is required for adjusting the shelf position or inclination. The shelves are often made with several pieces which must be taken apart and put back together when changing the position or inclination of the shelves. Some shelves do not permit inclination adjustment.

Most shelves are supportable only from underneath. This may create wasted shelf space in certain applications in the area needed beneath the bottom shelf for the shelf support. Another disadvantage of many shelves is that the brackets extend across two-thirds or more of the shelf thus restricting the loading and unloading of products through the sides of the shelves.

SUMMARY OF THE INVENTION

This invention is directed to an adjustable cantilevered shelf comprising an upright support means, a shelf which is mounted to the upright support means and bracket means for further supporting the shelf. The bracket means may be pivoted to a variety of positions to provide a choice of shelf inclinations and to allow shelf support from either beneath or above the shelf.

According to the preferred embodiment of the invention, a single unitary U-shaped bracket pivots about an axis which is closer to the rear of the shelf than the front of the shelf. The use of a single bracket for shelf support enhances the shelf strength by distributing the weight over the entire width of the bracket. By positioning the bracket closer to the rear of the shelf, there is more space available for movement of items through the sides of the shelves. Also, when the shelf is supported by the bracket from above, items in the rear of the shelf are restrained from falling off the sides. Another advantage of supporting the shelf from above is that the bottom shelf can be placed very close to the floor of the unit so as not to waste unnecessary shelving space.

The shelves of the present invention are attached to the upright support by the engagement of solid balls securely fixed to the shelves which insert into keyhole slots in the uprights. This provides a secure universal joint which reduces stress concentration and which can be easily detached for easily changing the position or inclination of the shelves.

The bracket arm length and pivot point are preferably selected such that when the shelf is supported from below at a forward declination of approximately 30°, the angle subtended by the shelf and the bracket arm is approximately 60°. It has been found that this provides an optimum dimensional relationship to insure secure engagement of the solid balls of the shelf in the keyhole slots at the desired shelf angular positions.

Another advantage of the adjustable cantilevered shelf is the ease of packaging the shelf. The bracket is a single member which can pivot into a position parallel with the shelf so that the whole shelf apparatus can be easily slid into a narrow box.

Other objects and advantages of the invention will become apparent during the following description of the presently preferred embodiment of the invention taken in conjunction with the drawings.

DETAILED DESCRIPTION OF THE PREFERRED EMBODIMENT

Figures 1, 2, 3:
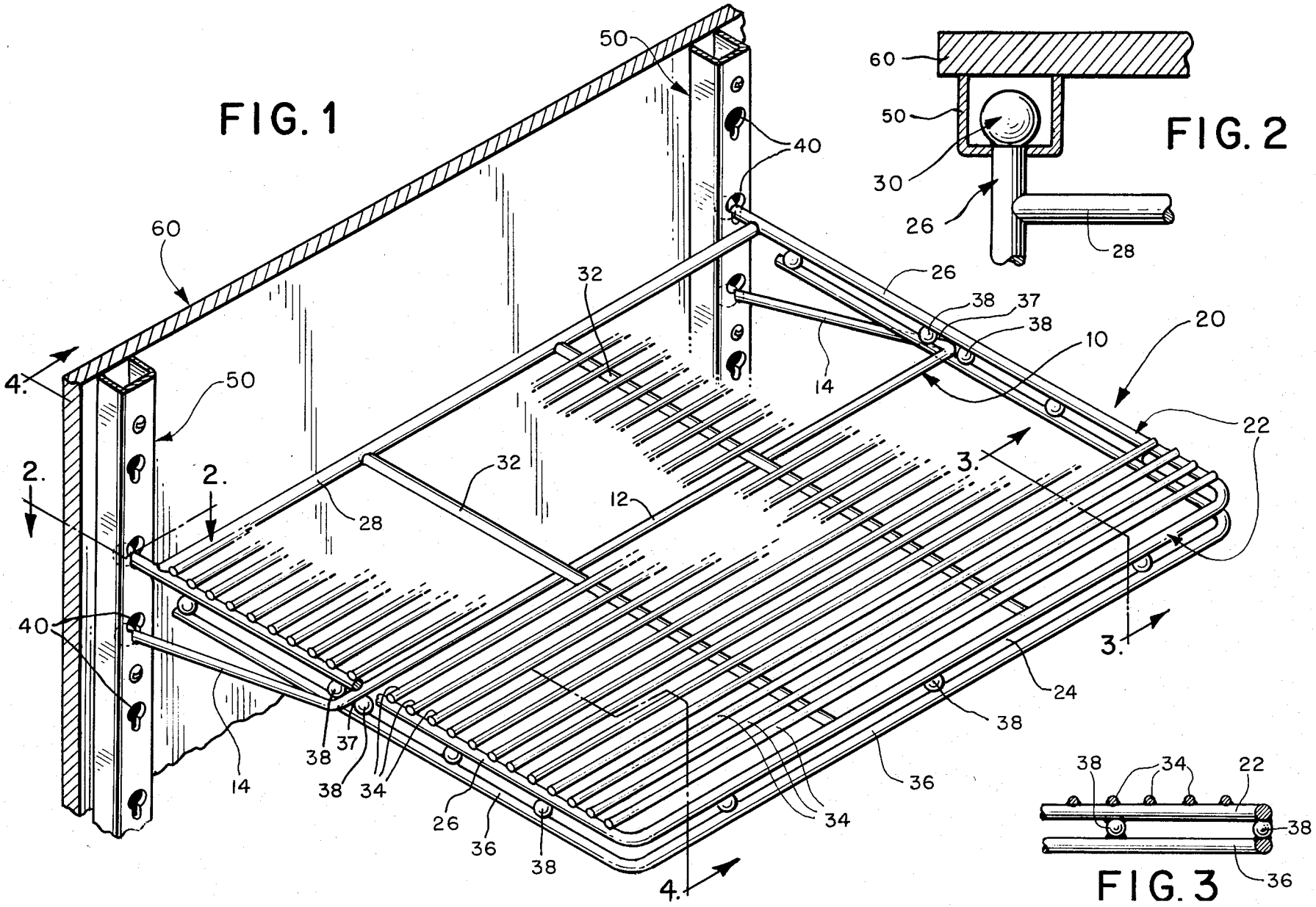
FIG. 1 is a perspective view of the preferred embodiment of the adjustable cantilevered shelf being supported from beneath.
FIG. 2 is a top sectional view of the engagement between the adjustable cantilevered shelf and the upright support.
FIG. 3 is a sectional side view of the cantilevered shelf.
Figure 6:
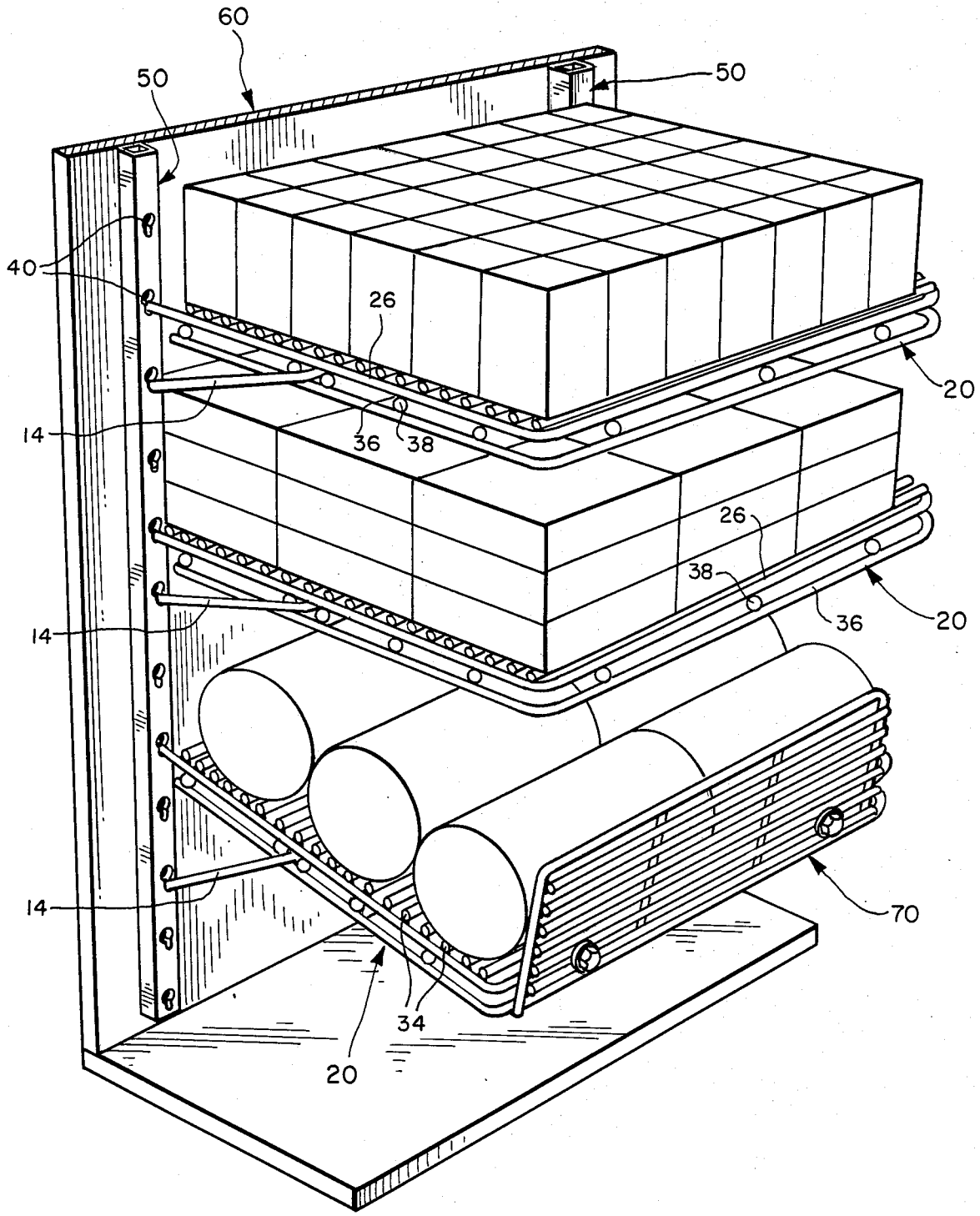
FIG. 6 is a perspective view of the cantilevered shelfing in a display case.

Referring now to FIG. 1, the adjustable cantilevered shelf is shown in a horizontal position supported by bracket means from beneath. In the preferred embodiment, the bracket means is a U-shaped bracket 10. The bracket 10 is pivotally engaged with shelf 20. The bracket 10 can rotate about the shelf to support the shelf from either above or below. The shelf 20 and the bracket 10 are detachably engaged into keyhole slots 40 located along upright supports 50. The upright supports 50 are secured against a wall 60. The adjustable shelving system is typically used in refrigeration display cases such as those found in supermarkets and illustrated in FIG. 6.

Looking at the shelf 20 in detail, there is a U-shaped top frame 22 made of 0.375 inch diameter around rod. The front portion of the top frame 22 forms the front edge 24 of the shelf. The front edge is approximately 30 inches long. Side portions 26 of the top frame 22 extend at right angles from the front edge 24. The side portions 26 are about 23 inches long. A cross-bar forms the rear edge 28 of the shelf 20. Each end of the rear edge 28 is welded to the side portions 26, parallel with the front edge 24 and coplanar with the top frame 22. The side portions 26 extend about 0.5 inches beyond the rear edge 28. At the ends of each of the side portions 26 there is a steel ball 30 securely attached by T-welding. The attachment between a steel ball 30 and a side portion 26 can be seen most clearly in FIG. 2. The steel balls 30 are about 0.625 inches in diameter. They must be larger in diameter than the round rod of the side portions 26. This enables the steel balls 30 to lock into the keyhole slots 40.

Two center bars 32 made of 0.375 inch diameter round rod are welded at one end to the rear edge 28 and at the other end to the front edge 24. The center bars 32 are parallel to and coplanar with the side portions 26. The center bars 32, the rear edge 28 and the U-shaped top frame 22 form a rigid weight bearing structure on top of which a multitude of 0.125 inch diameter round wires 34 are attached. The round wires 34 are parallel to the front and rear edges of the shelf 20. The round wires 34 are welded to the side portions 26 and the center bars 32. A surface for product placement which allows air to freely circulate is created by the round wires 34.

The shelf 20 has a U-shaped bottom frame 36 which does not extend beyond the rear edge 28 of the shelf 20. The U-shaped bottom frame 36 is located directly beneath the U-shaped top frame 22. The two frames are separated by 0.437 inch diameter steel ball spacers 38 which are welded to both the top and bottom frames. The dual frame construction helps create a rigid shelf. FIG. 3 shows a side view of the dual frame shelf construction.

Two steel ball spacers 38 on each side of the shelf frame form pivot apertures 37 which position the U-shaped bracket 10. The U-shaped bracket 10 is a one-piece unitary member of 0.375 inch wire. The bracket 10 has an axial portion 12 and two arms 14 which extend approximately ten inches at angles slightly less than 90° from the axial portion 12. The axial portion 12 extends through and between each of the pivot apertures 37 created by the steel ball spacers 38. The pivot apertures 37 are positioned exactly opposite each other so that the axial portion 12 will be parallel to the front and rear edges of the shelf. The pivot apertures 37 are preferably closer to the rear edge 28 of the shelf 20 than to the front edge 24. In the preferred embodiment, the pivot apertures 37 are about nine inches from the rear edge 28 and are created with the steel ball spacers 38 spaced approximately 2 inches between centers to capture the bracket axial portion 12 with a looseness of fit of about 1 3/16 inches. The axial portion 12 is fixed in position, but is free to rotate. As the axial portion 12 rotates, the arms 14 pivot about the axis of the portion 12. At the junctions between the arms 14 and the axial portion 12, there is about a $\frac{1}{8}$ inch space between the side portions 26 of the shelf and the arms 14. At the opposite ends of the arms 14, the side portions 26 of the shelf are about the same distance apart as the arms 14 of the bracket. Thus, to rotate the bracket 10 from beneath the shelf 20 to a position above the shelf, the arms 14 are manually pulled apart slightly. The bracket 10 is flexible enough to return to its original shape after being pulled apart.

At the ends of each of the arms 14 of the bracket 10 there are two 0.625 inch diameter steel balls 30 securely attached by T-welding, just as there are at the ends of the side portions 26. It is the universal cooperation between these steel balls 30 and the keyhole slots 40 which provides for easy adjustability and sturdy shelf support with reduced stress concentration at the engagement points. The keyhole slots 40 are located every two inches along the upright supports 50 which are secured to the rear wall 60. A self 20 cooperates with two upright supports 50. Each support 50 is positioned so that for each keyhole slot 40 on one support there is a keyhole slot 40 on the other support horizontally aligned with it. The upright supports 50 are separated by a distance such that each pair of horizontally aligned keyhole slots is separated by one shelf width, the distance from one side portion of the shelf to the other side portion of the shelf, approximately 30 inches.

The steel balls 30 interlock with the keyhole slots 40. The top of the keyhole slot is a circle with a radius of about 0.34 inches. It is a hole slightly larger than the steel balls 30 so that the balls may be inserted or removed by someone who wants to adjust the position of the shelf. The bottom of the keyhole slot has width of 7/16 inch and a radius of about 7/32 inch. This provides an opening narrower than the steel balls 30 but slightly larger than the rod connected to the steel ball. The same size wire rod is used in the arms 14 and the side portion 26. The length of the bottom of the keyhole slot is slightly longer than the diameter of the steel ball 30. This insures that the steel balls will remain locked within the slots.

Figure 4:
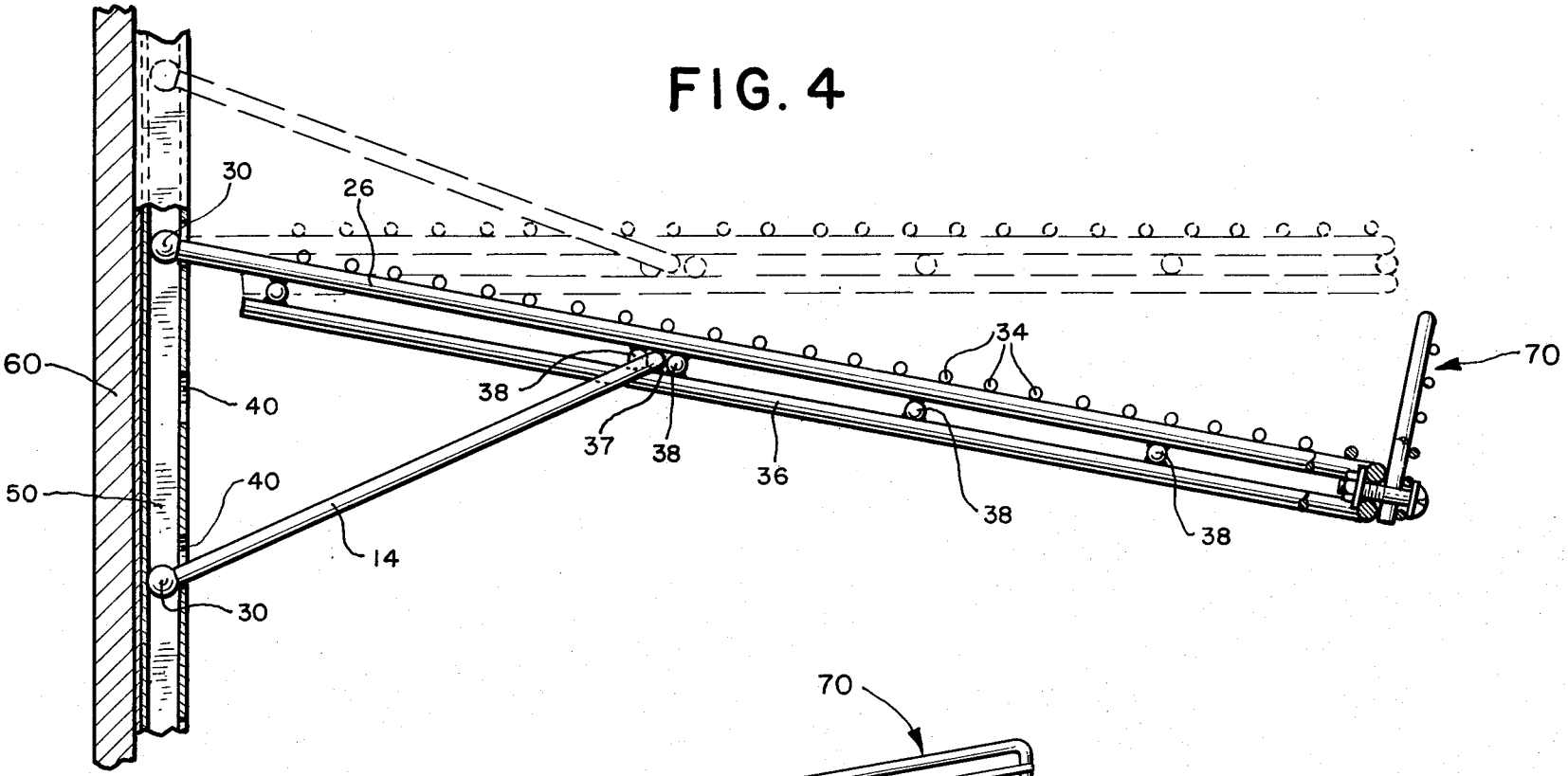
FIG. 4 is an isometric side view of the adjustable cantilevered shelf in two positions, a downwardly inclined position supported from beneath and a horizontal position supported from above.
Figure 5:
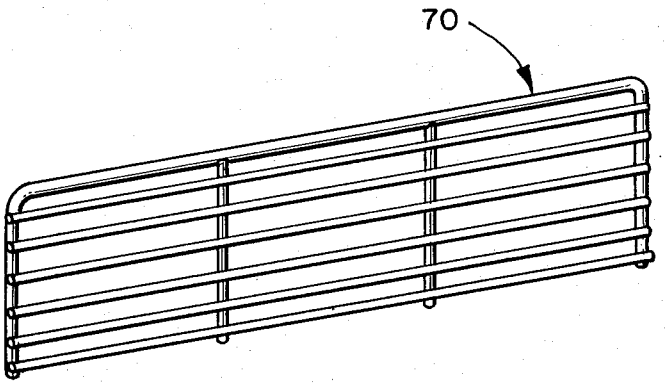
FIG. 5 is a perspective view of the retaining means used on the adjustable cantilevered shelf when it is in a downwardly inclined position.

Referring now to FIG. 4, the adjustability of the shelf is demonstrated. By simply detaching the bracket from its keyhole slot and moving it to a lower slot the shelf can be put into a declining position. Each successive keyhole slot in the downward direction produces a greater angle or decline. In the declining position, a retaining means would be needed at the front edge of the shelf to prevent items on the shelf from falling off. The retaining means 70 shown in FIGS. 4 and 5 can also be used to provide a space for displaying product or price information. The retaining means 70 is a wire frame which is vertically attached to the front of the shelf 20 with nuts and bolts.

It should be noted that in application in refrigeration shelving the shelf structure of the present invention will be positioned normally in either horizontally for static support of products or in a forwardly declining attitude for gravity feed of products toward the front of the shelf.

When the shelf is supported from below by the bracket 10, two inch spacing of the keyhole slots 40 results in a level position of the shelf when the bracket arms 14 are engaged with the first keyhole slot below the shelf. With engagement of the arms 14 in succeeding lower spaced keyhole slots 40, the attitude of the shelf declines at a rate of approxmately $7\frac{1}{2}°$ per slot. The bracket arm 14 length and the pivot aperture 37 positioning are preferably selected such that when the shelf is in a forward declination of approximately 30° from the horizontal (with the bracket arms engaged with the fifth keyhole slot below the shelf) the angle subtended by the shelf and the bracket arm 14 is approximately 60°. The shelf, the bracket arm, and the support structure form approximately an equilateral triangle in which each leg is in the region of 10 inches in length. The maximum forward declination of the shelf is approximately $37\frac{1}{2}°$ (with the bracket arms 14 engaged in the sixth keyhole slot 40 below the shelf). For any greater declination, the steel balls 30 will not enter the keyhole slots 40. Accordingly, at all angular positions of the shelf under such conditions from horizontal to the maximum declination of $37\frac{1}{2}°$, the angle subtended by the shelf and the bracket arms 14 remains an acute angle. Hence, the weight of the shelf and weight applied to the shelf has a tendency to pull the balls affixed to the shelf side portions 26 downwardly and forwardly in the keyhole slots 40 against the upright support 50 while pushing the balls affixed to the arms 14 of the bracket downwardly and rearwardly in the keyhole slots 40 against the wall 60. This push-pull action enhances the secure locking engagement of the shelf in the supports 50.

As further seen in FIG. 4, the adjustable cantilevered shelf of the present invention has the further advantage of allowing for bracket support form above the shelf. The shelf shown in broken lines is horizontally positioned and supported from above. In this position, the steel balls 30 at the ends of the bracket arms 14 are pulled downwardly and forwardly against the front of the upright supports 50. And the balls 30 at the ends of the side portions 26 of the shelf are pushed upwardly and rearwardly in their respective keyhole slots when weight is applied to the front of the shelf. Again the push-pull action enhances the locking engagement of the shelf in the supports 50. In allowing support from above the shelf, more efficient use of a refrigeration unit may be enabled since the bottom shelf can be supported very close to the floor of the enclosure. there is no need for space below the shelf to support it. It is also possible with this shelf to achieve an upward incline of the shelf if desired by detaching the bracket from its keyhole slot and moving it to a keyhole slot at a higher vertical position. The versatility of positioning provided by this adjustable cantilevered shelf allows for maximum utilization of cabinet space and for the most effective display of the products.

Of course, it should be understood that various changes and modifications to the preferred embodiment described above will be apparent to those skilled in the art. For Example, different materials could be used, the shelf could be a solid surface and the shelf could be used in applications other than refrigeration units. These and other changes can be made without departing from the spirit and the scope of the invention and without diminishing its attendant advantages. It is therefore intended that such changes and modifications be covered by the following claims.

We claim:

1. An adjustable cantilevered shelving comprising:

upright support means including a front member and a side member;

a shelf including a U-shaped top frame and U-shaped bottom frame, said U-shaped top frame and U-shaped bottom frame being secured together;

means extending from a rear edge of said shelf for adjustably mounting said shelf to said upright support means at a chosen vertical position;

a U-shaped bracket, including an axial portion and two arms, rotatably mounted between said U-shaped top frame and said U-shaped bottom frame of said shelf, whereby said arms pivot about the axis of said axial portion into positions above or below said shelf; and means for detachably engaging said arms of said U-shaped bracket to said front member of said upright support means to provide support for said shelf.

2. The adjustable shelf of claim 1 wherein said means extending from the rear portion of said shelf for mounting said shelf and said means for detachably engaging said arms of said U-shaped bracket are solid balls.

3. The adjustable shelf of claim 2 wherein:

said solid balls extend from the rear portion of said U-shaped top frame; and said U-shaped top and U-shaped bottom frame are secured together by spacer means.

4. The adjustable shelf of claim 3 wherein said spacer means define apertures on opposing sides of said shelf which receive said U-shaped bracket.

5. The apparatus of claim 4 wherein:

said front member of said upright support includes a plurality of keyhole slots for receiving said solid balls of said shelf and said arms; and said keyhole slots are so constructive arranged that by positioning said solid balls and said U-shaped bracket in a lower keyhole slot or an upper keyhole slot changes the slope of said shelf by approximately $7\frac{1}{2}$ degrees.

* * * * *

UNITED STATES PATENT AND TRADEMARK OFFICE

CERTIFICATE OF CORRECTION

PATENT NO. : 4,492,169

DATED : Jan. 8, 1985

INVENTOR(S) : Warren O. Ware et al.

It is certified that error appears in the above-identified patent and that said Letters Patent is hereby corrected as shown below:

IN THE SECTION ENTITLED "ATTORNEY, AGENT, OR FIRM"

Please delete all commas from the firm name, thereby making it --Willian Brinks Olds Hofer Gilson & Lione Ltd.--.

IN THE DETAILED DESCRIPTION OF THE PREFERRED EMBODIMENT

In column 2, line 40, please delete "around" and substitute therefor --round--;

In column 3, line 51, please delete "self" and substitute therefor --shelf--;

In column 3, line 65, please insert the word --a-- before the word "width";

In column 4, line 11, please delete the word "or" and substitute therefor --of--;

UNITED STATES PATENT AND TRADEMARK OFFICE

CERTIFICATE OF CORRECTION

PATENT NO. : 4,492,169

DATED : Jan. 8, 1985

INVENTOR(S) : Warren O. Ware et al.

It is certified that error appears in the above-identified patent and that said Letters Patent is hereby corrected as shown below:

In column 5, line 18, please delete "Example" and substitute therefor --example--.

Signed and Sealed this

Twelfth Day of April, 1988

*Attest:*

DONALD J. QUIGG

*Attesting Officer*

*Commissioner of Patents and Trademarks*